US005299878A

United States Patent [19]

Lin et al.

[11] Patent Number: 5,299,878

[45] Date of Patent: Apr. 5, 1994

[54] BINDER FOR RESERVOIR TUBES

[76] Inventors: Idea Lin; Chen Hiang, both of P.O. Box 82-144, Taipei, Taiwan

[21] Appl. No.: 850,982

[22] Filed: Mar. 11, 1992

[51] Int. Cl.[5] ..... B43K 27/12; B43K 7/00

[52] U.S. Cl. ..... 401/209; 401/34; 401/35; 401/89; 401/217

[58] Field of Search ..... 401/34, 35, 89, 90, 401/209, 217

[56] References Cited

U.S. PATENT DOCUMENTS 2,865,334 12/1958 Radzinsky ..... 401/209

3,310,035 3/1967 Cena ..... 401/209

*Primary Examiner*—Steven A. Bratlie

*Attorney, Agent, or Firm*—Alfred Lei

[57] ABSTRACT

This invention relates to a binder for reservoir tubes and in particular to one including a conical head formed with a longitudinal through hole at the center and a plurality of longitudinal blind holes around the longitudinal through hole at the center, and an end piece provided with a center positioning tubular member and a plurality of circular protuberances around the center positioning tubular member, whereby a plurality of reservoir tubes may be mounted between the conical head and the end piece and the tip of the reservoir tube at the center position will protrude out of the conical head thereby binding a plurality of reservoir tubes together and enabling the binder to be used a writing implement.

1 Claim, 2 Drawing Sheets

BINDER FOR RESERVOIR TUBES

BACKGROUND OF THE INVENTION

The prior art ball-point pen can receive only one a reservoir tube and so once the ink in the reservoir tube is used up, it is necessary to replace the reservoir tube with a new one. However, the ball-point pen and the spare reservoir tubes are usually stored in different places thereby often causing the user to spend much time in finding the spare reservoir tube.

Therefore, it is an object of the present invention to provide a binder for reservoir tubes which may obviate and mitigate the above-mentioned drawbacks.

SUMMARY OF THE INVENTION

This invention relates to a binder for reservoir tubes.

It is the primary object of the present invention to provide a binder for reservoir tubes which may be used as a writing implement when engaged with a plurality of reservoir tubes.

It is another object of the present invention to provide a binder for reservoir tubes which may bind a plurality of reservoir tubes together.

It is still another object of the present invention to provide a binder for reservoir tubes which is economic to produce.

It is still another object of the present invention to provide a binder for reservoir tubes which is compact in size.

It is a further object of the present invention to provide a binder for reservoir tubes which is facile to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
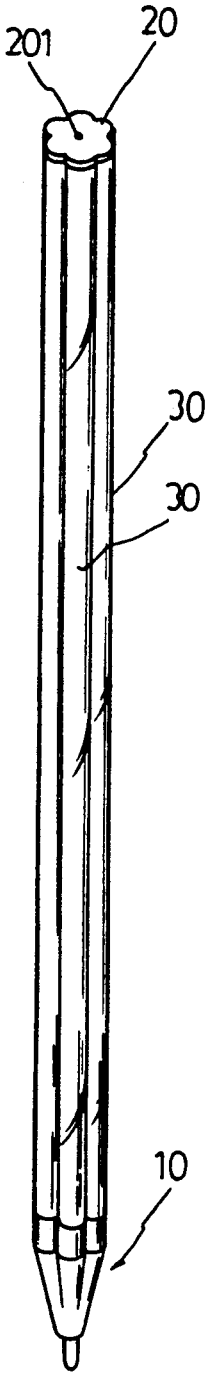
FIG. 1 is a perspective view of the present invention.
Figure 2:
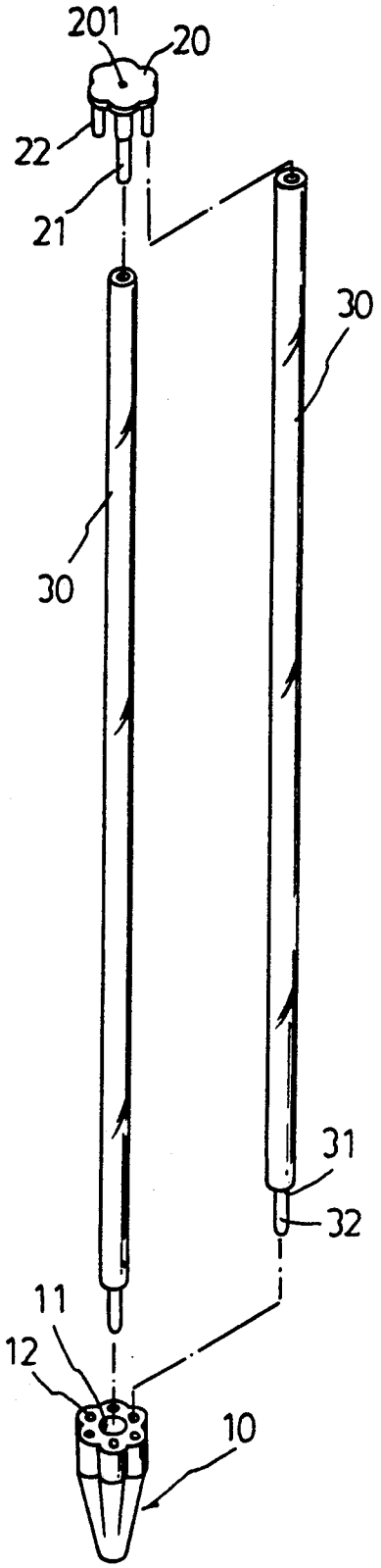
FIG. 2 is an exploded view of the present invention.
Figure 3:
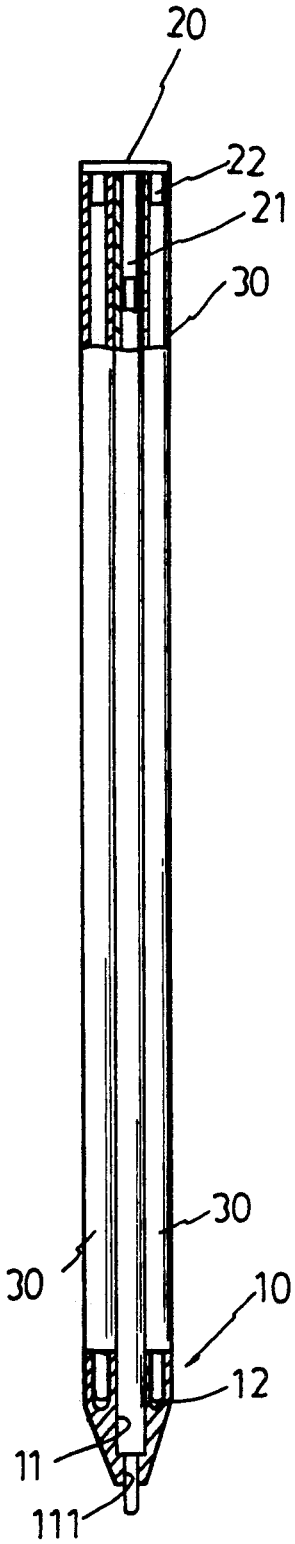
FIG. 3 is a sectional view of the present invention.

With reference to the drawings and in particular to FIGS. 1 and 2 thereof, the binder for reservoir tubes according to the present invention comprises a conical head 10 and an end piece 20 between which are mounted a plurality of reservoir tubes 30.

Figure 5:
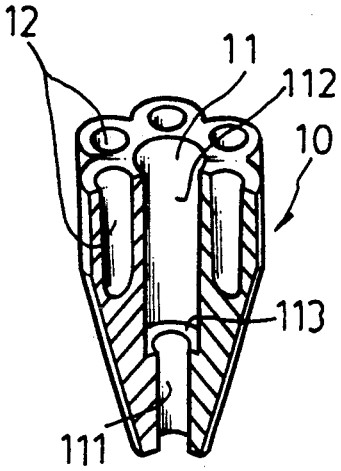
FIG. 5 shows the interior structure of the conical head.
Figure 6:
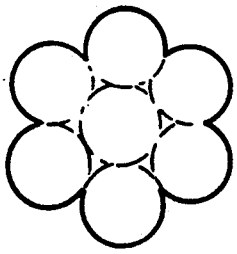
FIG. 6 is a top plan view of the present invention.

As illustrated in FIG. 5, the conical head 10 is formed with a longitudinal through hole 11 at the center and a plurality of longitudinal blind holes 12 around the longitudinal through hole 11 at the center. The longitudinal through hole 11 is composed of a lower passage 111 and an upper passage 112 between which there is a flange 113 adapted to support a shoulder 31 of a reservoir tube 30.

Figure 4:
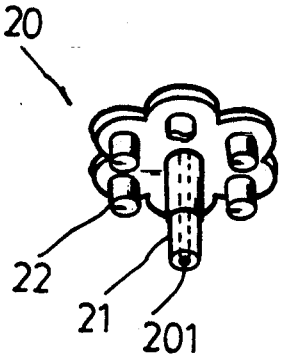
FIG. 4 is a perspective view of the end piece.

Looking now at FIG. 4, the end piece 20 is provided with a center positioning tubular member 21 and a plurality of circular protuberances 22 around the center positioning tubular member 21. The center positioning tubular member 21 is adapted to be inserted into the top end of a reservoir tube 30 and has a through hole 201 designed for enabling the ink in the reservoir tube 30 to flow out of its tip 32. Each of the circular protuberances 22 are adapted to bear against the top end of a reservoir tube 30.

When in use, simply insert the reservoir tubes 3 into the conical head 10 and engage the end piece 20 with the top ends of the reservoir tubes 3 so that the reservoir tubes 3 are kept in fixed position and the tip of the reservoir tube 3 at the center will protrude out of the lower end of the conical head 30 thereby enabling it to be used for writing as well as binding reservoir tubes together.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

We claim:

1. A binder for reservoir tubes comprising:

a conical head formed with a longitudinal through hole at a center and a plurality of longitudinal blind holes around the said longitudinal through hole at the center, said longitudinal through hole being composed of a lower passage and an upper passage between which there is a flange adapted to support a shoulder of a reservoir tube; and an end piece provided with a center positioning tubular member and a plurality of circular protuberances around the center positioning tubular member, said center positioning tubular member being adapted to be inserted into a top end of a reservoir tube and having a through hole designed for enabling ink in the reservoir tube to flow out of a tip thereof, each of said circular protuberances being adapted to bear against a top end of a reservoir tube.

* * * * *